US011696646B2

(12) United States Patent
Veneroni

(10) Patent No.: US 11,696,646 B2
(45) Date of Patent: Jul. 11, 2023

(54) KIT FOR ADAPTING FOLDABLE CHAIRS TO MAKE THEM SUITABLE AS CARRIERS FOR UMBRELLAS AND OTHER ELONGATE OBJECTS

(71) Applicant: Anthony Robert Veneroni, New York, NY (US)

(72) Inventor: Anthony Robert Veneroni, New York, NY (US)

( * ) Notice: Subject to any disclaimer, the term of this patent is extended or adjusted under 35 U.S.C. 154(b) by 116 days.

(21) Appl. No.: 17/327,947

(22) Filed: May 24, 2021

(65) Prior Publication Data

US 2022/0369818 A1 Nov. 24, 2022

(51) Int. Cl.
*A47C 7/66* (2006.01)

(52) U.S. Cl.
CPC ..... *A47C 7/664* (2018.08)

(58) Field of Classification Search
CPC ..... A47C 7/62; A47C 7/622; A47C 7/624; A47C 7/66; A47C 7/664; A47C 1/14; A47C 5/10; A45B 23/00; A45B 23/0006; A45B 2200/1009
USPC ... 297/184.16, 184.15, 188.01, 463.1, 463.2, 297/184.1, 188.2; 135/16, 98
See application file for complete search history.

(56) References Cited

U.S. PATENT DOCUMENTS 122,370 A * 1/1872 Doolittle ..... A01K 97/10 248/515
1,525,515 A * 2/1925 Socha ..... B60R 13/00 248/541
2,556,206 A * 6/1951 Militano ..... A47C 7/66 248/515
2,618,285 A * 11/1952 Heisig ..... A45B 11/00 403/109.5
3,050,280 A * 8/1962 Regan ..... A45B 11/00 135/96
3,848,838 A * 11/1974 Thomas ..... A47C 7/66 248/231.51
3,904,161 A * 9/1975 Scott ..... A45B 11/00 248/231.71
3,935,874 A * 2/1976 Cohen ..... A47C 7/664 135/25.41
4,201,416 A * 5/1980 Vanderminden ..... A47C 7/66 297/184.15

(Continued)

FOREIGN PATENT DOCUMENTS

KR 10-2017-0081831 7/2017
WO 2007/116107 A1 10/2007

OTHER PUBLICATIONS

KR 10-2017-0081831 A date Jul. 13, 2017 _ English Translation.

*Primary Examiner* — James M Ference
(74) *Attorney, Agent, or Firm* — Ladas & Parry LLP

(57) ABSTRACT

A kit for mounting an elongate object on a foldable chair. The kit includes: a mount having (a) a generally planar member; (b) a first projection from the front side of the generally planar member configured for receiving a first end of the elongate object, (c) a second projection from the back side of the generally planar member configured for mounting the mount on a first tubular member of the chair with the chair in a folded configuration; and a strap for detachably attaching the shaft of the elongate object to a second tubular member of the chair with the end of the elongate object received in the mount. Also, a method for using the kit to enable a user to transport the elongate object with the foldable chair.

20 Claims, 4 Drawing Sheets

(56) References Cited

U.S. PATENT DOCUMENTS 4,230,363 A * 10/1980 Borichevsky ..... A47C 7/66 248/230.8
4,470,630 A * 9/1984 Shields ..... A47C 1/146 297/118
4,781,411 A * 11/1988 Kolb ..... B63B 17/02 248/397
4,865,381 A * 9/1989 Van Rogue ..... A47C 7/66 135/96
4,903,929 A * 2/1990 Hoffman ..... B25B 5/101 248/229.15
5,000,210 A * 3/1991 Worthington, Jr. ..... A47C 7/66 135/96
5,013,085 A * 5/1991 Craig ..... A47C 1/143 135/90
5,096,257 A * 3/1992 Clark ..... A47C 1/143 135/96
5,110,184 A * 5/1992 Stein ..... A47C 7/008 297/344.26
5,350,215 A * 9/1994 DeMars ..... A47C 7/624 297/188.14
5,411,237 A * 5/1995 Dougherty ..... A45B 11/00 224/274
5,431,364 A * 7/1995 Etter ..... A45B 11/00 248/514
5,441,067 A * 8/1995 James ..... A47C 7/66 135/96
5,478,041 A * 12/1995 Mayne ..... A47C 7/66 248/314
5,564,452 A * 10/1996 Kitchen ..... E04F 10/00 135/96
5,579,797 A * 12/1996 Rogers ..... A45B 23/00 135/96
5,638,849 A * 6/1997 Scott ..... A47C 7/66 297/188.05
5,641,197 A * 6/1997 Springmann ..... A47C 7/66 248/512
D383,967 S * 9/1997 DeMars ..... D8/354
D389,334 S * 1/1998 Attridge ..... D3/10
5,749,386 A * 5/1998 Samuel, Jr. ..... A45B 3/00 248/530
5,836,327 A * 11/1998 Davis ..... F16M 13/022 248/515
5,873,550 A * 2/1999 Phillips ..... F16L 3/1075 248/74.1
D413,429 S * 9/1999 Carson ..... D3/10
6,082,694 A * 7/2000 Joyce ..... A63B 55/50 403/143
6,105,594 A * 8/2000 Diaz ..... A45B 17/00 135/88.03
6,113,129 A * 9/2000 Marques ..... B62B 1/12 280/654
6,131,925 A * 10/2000 Weldon ..... B62B 1/12 280/30
6,199,819 B1 * 3/2001 Churillo ..... A45B 11/00 135/16
6,234,187 B1 * 5/2001 Izzo ..... A45B 11/00 248/297.21
6,244,557 B1 * 6/2001 Maze ..... B62B 9/147 248/230.8
6,401,736 B1 * 6/2002 Jerry ..... A45B 11/00 135/25.4
6,520,574 B1 * 2/2003 Huang ..... A47C 7/66 248/515
6,666,221 B1 * 12/2003 Booth ..... A45B 11/00 297/188.2
7,201,442 B1 * 4/2007 Decosta, Jr. ..... A47C 7/66 248/539
7,226,126 B1 * 6/2007 Spanovich ..... A47C 4/286 248/539
7,527,330 B2 * 5/2009 Montpas ..... A47C 7/66 297/188.2
7,562,930 B1 * 7/2009 Rondeau ..... A47C 7/66 297/45
8,490,255 B1 * 7/2013 Alhanati ..... A45C 13/30 248/524
8,864,221 B1 * 10/2014 Delvilla ..... A47C 7/5066 297/180.12
9,532,559 B1 * 1/2017 Hemmerlin ..... F16M 13/02
9,851,050 B1 * 12/2017 Cano ..... A45B 11/00
10,154,659 B2 * 12/2018 Smith ..... A01K 97/10
10,526,810 B1 * 1/2020 Boos ..... E04H 12/32
2002/0145316 A1 * 10/2002 Oliver ..... A47C 7/66 297/217.1
2003/0037811 A1 * 2/2003 Altobelli ..... A47C 7/42 135/16
2003/0140953 A1 * 7/2003 Kersey, Jr. ..... A45B 11/00 135/16
2004/0222678 A1 * 11/2004 Hansen ..... A47C 7/66 297/184.1
2007/0096004 A1 * 5/2007 Quiambao, Jr. ..... A45B 11/00 248/534
2007/0236058 A1 * 10/2007 Yeider ..... A47C 7/664 297/184.1
2009/0072597 A1 * 3/2009 Montpas ..... A47C 7/62 297/217.1
2010/0207429 A1 * 8/2010 Quinn ..... A47C 7/664 297/16.1
2012/0062002 A1 * 3/2012 Quinn ..... A47C 7/66 297/184.16
2013/0074741 A1 * 3/2013 Li ..... A47C 7/66 108/50.11
2013/0074743 A1 * 3/2013 Li ..... A47C 7/664 297/118
2014/0263926 A1 * 9/2014 LeAnna ..... E04H 12/2253 248/518
2018/0353357 A1 * 12/2018 Lane ..... A01M 31/02
2022/0369818 A1 * 11/2022 Veneroni ..... A47C 5/10

* cited by examiner

KIT FOR ADAPTING FOLDABLE CHAIRS TO MAKE THEM SUITABLE AS CARRIERS FOR UMBRELLAS AND OTHER ELONGATE OBJECTS

FIELD OF INVENTION

A kit for adapting a foldable chair to make it suitable for detachably mounting an elongate object on the chair to make it easy for a person to transport the chair and the elongate object together. The kit is especially useful for carrying an umbrella and beach chair to the beach. Also, a mount for the elongate object and a method of transporting a foldable chair and the elongate object together.

BACKGROUND OF THE INVENTION

Anyone who has lugged a beach chair and an umbrella to the beach knows how cumbersome and awkward it is to carry both of these objects at one time. For that reason, the art is replete with patents and publications that describe carts or caddies that can be used to carry umbrellas and other useful objects to the beach.

By way of example, WO 2007/116107 and U.S. Pat. No. 6,131,925 describe carts cum foldable chairs with means for transporting umbrellas when the cart/chairs are in their folded configurations. The carts/chairs described in this patent and patent publication are desired for transporting an umbrella to the beach on the cart/chair. However, these publications presuppose that a user will be satisfied sitting on a converted cart rather than on a beach chair that he or she has chosen for comfort. Moreover, the publications do not describe how a user might adapt a favorite beach chair that is already in the user's possession into a mount for an umbrella to facilitate transport of the beach chair and umbrella as a single unit.

There is also known in the art many examples of umbrella holders that are adapted to be mounted on beach chairs once a beachgoer has arrived at a desired spot at the beach and has unfolded the beach chair to prepare for a day of relaxation at the beach. These include, by way of example, U.S. Pat. No. 8,490,255, US Patent Application Publication 2007/0096004 and U.S. Pat. No. 7,201,442. The '255 patent and the '004 patent publication describe umbrella mounts, including cuffs and tubes, for receiving a handle end (as opposed to a canopy end) of an umbrella that is attachable to a single, vertically disposed portion of a beach chair in an orientation that makes the umbrella, suitable for use in blocking the sun when the beach chair is in an unfolded configuration. This is not a disposition and orientation that facilitates transport of the umbrella with the beach chair in a folded configuration.

The '442 patent describes mounting plates comprising compression fittings for receiving the handle end of an umbrella with the mounting plates mounted on the back of a chair. The mounting plates are detachably mountable on tubular frame members of at least one beach chair with the use of U bolts that fit around the tubular frame members with their ends passing through holes in the mounting plates where they can be secured. As with the '255 patent and the '004 patent publication, the disposition and orientation of the mounting plates do not facilitate their use in transport of an umbrella and folded beach chair together.

What has been needed is a kit that can simply and efficiently adapt a beach chair or other foldable chair of a user's choosing into a mount for an umbrella or other elongate object that enables the user easily to transport the chair and elongate object as a unit to the beach or other desired location.

SUMMARY OF THE INVENTION

In accordance with a first embodiment of the invention, there is provided a kit for adapting a foldable chair to permit an elongate object to be mounted on the chair when the chair is folded to enable the elongate object and chair to be carried as a single unit. In a preferred aspect of this embodiment, the foldable chair is a beach chair that comprises a frame that, in a folded configuration, comprises (i) first and second tubular members disposed parallel to each other and (ii) third and fourth tubular members disposed parallel to each other and perpendicular to the first and second tubular members. In a preferred embodiment, the elongate object is an umbrella that comprises opposed first and second ends and a shaft extending between the first and second ends, wherein the shaft has a length that is greater than a distance between the first and second tubular members of the beach chair.

In a preferred aspect of the first embodiment, the kit comprises:

(a) a mount comprising (i) a generally planar member having a front side, a back side, a top, a bottom and first and second opposed ends, the generally planar member having a length between the first and second ends that is greater than a width between the top and the bottom, (ii) first means projecting from the front side of the generally planar member for receiving the first end of the elongate object with the chair in a folded configuration, (iii) second means projecting from the back side of the generally planar member for mounting the mount on the first tubular member of the chair with the chair in the folded configuration, the first and second means being configured such that, with the chair in the folded configuration, with the first means receiving the first end of the elongate object and with the second means mounting the mount on the first tubular member, the shaft of the elongate object extends from the first means to and past the second tubular member of the chair; and (b) third means for detachably attaching the shaft of the elongate object to the second tubular member of the chair with the shaft of the elongate object perpendicular to the second tubular member, with the first means receiving the first end of the elongate object and with the second means mounting the receptable member on the first tubular member of the chair.

In another preferred aspect of the first embodiment, the first means comprises a U-shaped cup with legs of the U-shaped cup projecting from a central portion of the front side of the generally planar member and the U-shaped cup has a longitudinal axis that is perpendicular to the length of the planar member.

In yet another preferred aspect of the first embodiment, the U-shaped cup comprises an open top and a closed or substantially closed bottom that prevents the first end of the elongate object from extending below the bottom of the planar member with the first end of the elongate object received in the U-shaped cup and the shaft of the elongate object attached to the second tubular member of the chair. The bottom of the U-shaped cup is preferably aligned with the bottom of the generally planar member.

In still another preferred aspect of the first embodiment, the second means comprises first and second fins projecting from a central portion of the back side of the planar member.

The first and second fins preferably define an opening for mounting the mount on the first tubular member which is in the shape of a partial cylinder having a longitudinal axis that is parallel to the length of the planar member. Preferably, the opening is dimensioned to allow the first and second fins to partially encircle the first tubular member to enable the mount to slide along the first tubular member when the mount is mounted on the first tubular member. Preferably, a bottom of the first fin is aligned with the bottom of the generally planar member and the second fin is disposed above the first fin on the back of the generally planar member.

In still another preferred aspect of the first embodiment, the generally planar member has first and second flanges that extend beyond the first and second means on opposite sides of the central portion with the width of the planar member gradually narrowing along the length of the planar member from the central portion toward the respective first and second ends of the planar member. Preferably, the planar member has a generally semi-circular shape and the mount is of unitary construction.

In yet another preferred aspect of the first embodiment, the third means comprises a strap or plurality of straps. In a most preferred aspect of the first embodiment, the third means comprises a cinch strap with Velcro closing means.

In a still further aspect of the first embodiment, the kit comprises means for fastening the planar member to one or two of the first, second, third and fourth tubular members, preferably to two of the tubular members in an area where they intersect. Preferably, the means for fastening the planar member to the tubular member or members comprises a plurality of self-threading screws and the planar member comprises a plurality of holes disposed in the respective central portion, first end portion and/or second end portion for facilitating use of the self-threading screws to fasten the planar member to the tubular member or members.

In accordance with a second embodiment of the invention, there is provided a mount for an elongate object comprising (a) a generally planar member having a front side, a back side, a top, a bottom and first and second opposed ends, the planar member having a length between the first and second ends that is greater than a width between the top and the bottom of the planar member;

(b) first means projecting from the front side of the planar member for receiving the first end of the elongate object, wherein the first means comprises a U-shaped cup with legs of the U-shaped cup projecting from a central portion of the front side of the planar member, the U-shaped cup having a longitudinal axis that is perpendicular to the length of the planar member, wherein the U-shaped cup comprises an open top and a closed or substantially closed bottom that prevents the first end of the elongate object from extending below the bottom of the planar member with the first end of the elongate object received in the U-shaped cup, and wherein the bottom of the U-shaped cup is aligned with the bottom of the planar member;

(c) second means projecting from the back side of the planar member for mounting the article on a tubular member of a foldable chair with the chair in a folded configuration, wherein the second means comprises first and second fins projecting from a central portion of the back side of the planar member, the first and second fins defining, an opening for mounting the article on the tubular member of the chair, the opening being in the shape of a partial cylinder having a longitudinal axis that is parallel to the length of the planar member, the opening being dimensioned to allow the first and second fins to partially encircle the tubular member and to slide the mount along the first tubular member with the mount mounted on the tubular member, wherein a bottom of the first fin is aligned with the bottom of the generally planar member and the second fin is disposed above the first fin on the back of the generally planar member.

In a preferred aspect of this second embodiment, the generally planar member has first and second flanges on opposite sides of the central portion and the width of the planar member gradually narrows from the central portion toward the respective first and second ends of the planar member. Preferably, the planar member has a generally semi-circular shape and is of unitary construction.

In accordance with a third embodiment of the invention, there is provided a method for transporting an elongate object together with a folded chair comprising the steps of:

(a) providing the kit described above;

(b) mounting the mount of the kit onto a tubular member of a folded chair at one end of the folded chair;

(c) inserting one end of the elongate object into the mount;

(d) attaching a shaft of the elongate object to an opposite end of the folded chair with a strap or straps of the third means; and (e) transporting the elongate object and chair as a single assembly.

In a most preferred aspect of the third embodiment, the chair is a beach chair and the elongate object is an umbrella.

BRIEF DESCRIPTION OF THE DRAWINGS

These and other features and advantages of the present disclosure will be apparent from the following detailed description, appended claims, and accompanying drawings in which:

DETAILED DESCRIPTION

Figure 1:
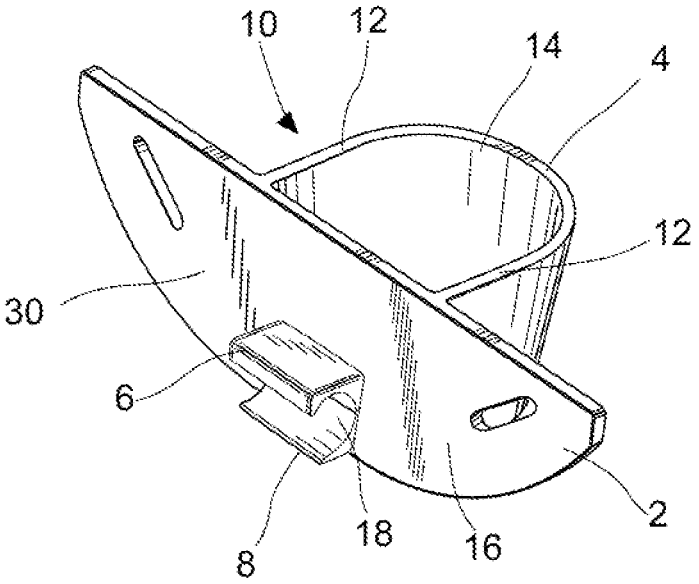
FIG. 1 is a rear perspective view of a mount for use in the kit of the invention in a preferred embodiment.
Figure 2:
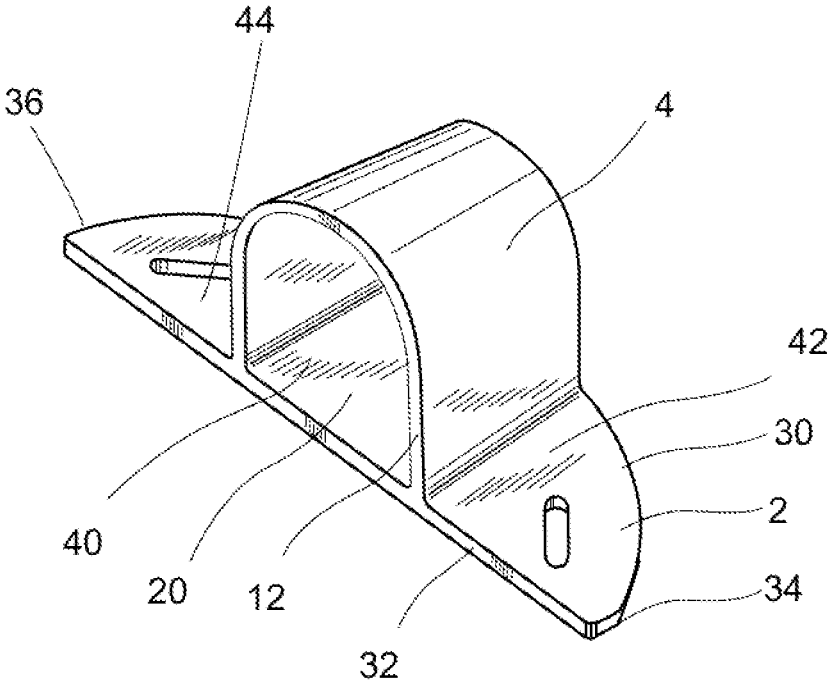
FIG. 2 is a front perspective view of the mount shown in FIG. 1.
Figure 3:
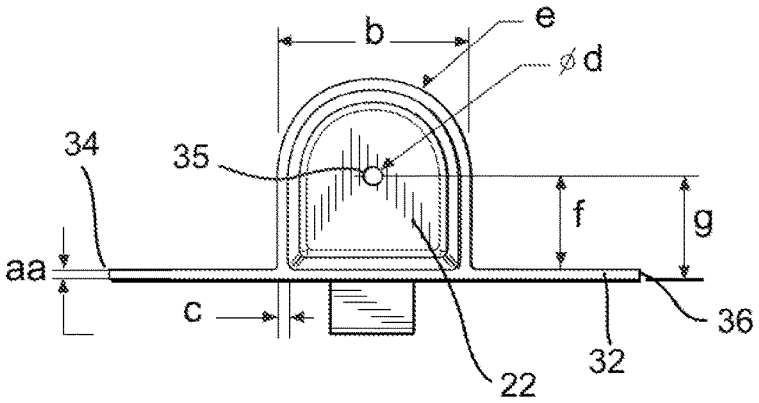
FIG. 3 is a top plan view of the mount shown in FIG. 1.

The exemplary embodiments described herein in detail for illustrative purposes are subject to many variations in structure and design. It should be emphasized, however, that the present disclosure is not limited to a particular apparatus for securing an article to an external object as shown and described. It is understood that various omissions and substitutions of equivalents are contemplated as circumstances may suggest or render expedient, but these are intended to cover the application or embodiment without departing from the spirit or scope of the claims of the present disclosure. Also, it is to be understood that the phraseology and terminology used herein are for the purpose of description and should not be regarded as limiting.

The use of "including," "comprising," or "having" and variations thereof herein is meant to encompass the items listed thereafter and equivalents thereof as well as additional items. The terms such as "first," "second," "outer," "inner" and other variations thereof as used herein, do not denote an order, elevation or importance, but rather used signify the presence of at least one of the referenced items. Further, the terms, "a" and "an" herein do not denote a limitation of quantity, but rather denote the presence of at least one of the referenced item.

Referring to FIGS. 1-6, there is shown a mount 10 of the invention in a preferred embodiment. The mount 10 comprises a generally flat or planar member 2, a cup member 4 projecting perpendicularly from a central portion 40 on the front side 20 of planar member 2 and a pair of fins 6, 8 projecting perpendicularly from the central portion 40 on the rear side 16 of planar member 2. In a preferred embodiment of the invention, the mount 10 is made by injection molding and is of unitary construction.

The planar member 2 has a bottom 30, a top 32 and opposed ends 34, 36. The length of the planar member 2 (the distance between opposed ends 34, 36) is preferably greater than its width (the distance between top 32 and bottom 30 at its lowest point). The planar member 2 has flange portions 42 and 44 flanking central portion 40. The flange portions extend beyond the cup 4 on the front side 20 of planar member 2 and beyond the fins 6, 8 on the rear side of planar member 2. In a preferred embodiment of the invention, the flange portions 42 and 44 taper gradually from the central portion 40 to the ends 34, 36 of the planar member 2. In a preferred embodiment, the top 32 of the mount is straight and the planar member is of generally semicircular shape. Although the planar member can also have straight edges, a curved or semicircular shape is preferable because it enables the mount to be aligned with the contour of a tubular rail at the intersection of the bottom and side rails of a beach chair. This helps in centering holes into the center of the rails to insert self-drilling screws in a preferred embodiment of the invention.

In a preferred embodiment, the cup 4 is of generally U-shape with legs 12 projecting from the front side 20 of planar member 2 and with an arcuate base 14 of the U-shaped cup spaced from the front side 20 of planar member 2. The cup 4 has a bottom 22 (FIG. 3) that serves as a means for receiving the top end of an umbrella or other elongate object and for preventing it from passing below the bottom of the cup. Although the bottom may be completely closed, it is preferable that it has an opening 35 in the bottom to allow water and/or sand to drain out. The opening 35 should preferably be no bigger than the top of an umbrella to prevent the umbrella from sliding out from the bottom of the cup. Alternatively, the bottom of the cup 4 can comprise a ring with side walls dimensioned to prevent the umbrella from sliding out from the bottom of the cup 4.

The fins 6, 8 projecting from the rear side 16 of planar member 2 are curved toward each other and define a mouth 18 for encircling a tubular rail in the frame of a chair. The mouth 18 defined by the fins 6, 8 is preferably of partial cylindrical shape with the longitudinal axis of the partial cylinder being parallel to the length of the planar member 2. The radius r of the partial cylinder is preferably dimensioned so that the mouth 18 defined by fins 6, 8 can encircle the tubular rail of a chair with a small tolerance to allow the fins to slide along the rail to a desired point of mounting. It is preferable for the mount to be slidable as this makes it easier to line up a curved part of the planar member 2 with a side rail of a beach chair. This also helps in centering holes into the centers of the rails of a beach chair to insert self-drilling screws in a preferred embodiment of the invention.

Although the top fin 6 and the bottom fin 8 can be of equal size, it is preferable that one of the fins extends from the planar member 2 a greater distance than the other because, if they are of equal size, the opening may become too tight to fit around the rail of a beach chair. Although it is possible to construct the fins with the top fin 6 extending out further than the bottom fin 8, it is preferable that the bottom fin 8 extends out further. This provides the mount with a little extra support.

The preferred dimensions of the respective parts of the mount in a preferred embodiment of the invention are described with respect to FIGS. 3-6 of the drawings wherein the respective dimensions, designated by letters a-z and aa in the figures, are as follows (all dimensions are in inches unless otherwise specified):

| Letter | Preferred Dimension |
|---|---|
| a | 4 to 24 |
| b | 3 to 8 |
| c | ⅛ to ¾ |
| d | ⅛ to 3½ (diameter) |
| e | 1 to 3 (radius) |
| f | ⅛ to 3½ |
| g | ¼ to 3½ |
| h | 3 to 10 |
| i | 1 to 4 |
| j | 2 to 6 |
| k | 3 to 5 (radius) |
| l | 2 to 5 |
| m | ½ to 3½ |
| n | 1 to 7 |
| o | 1/16 to 1¾ (diameter) |
| p | 0.5 to 1.5 (radius) |
| q | 1/16 to ½ (diameter) |
| r | ¼ to 1 |
| s | ¼ to 1¾ |
| t | 0 to .25 (radius) |
| u | ¼ to 1¾ |
| v | ¼ to 1¾ |
| w | ⅛ to 1 |
| x | ⅛ to 1 |
| y | 0 to 10 degrees |
| z | 0 to 1 (radius) |
| aa | ⅛ to ¾ |
| bb | ⅛ to ¾ |

Figure 4:
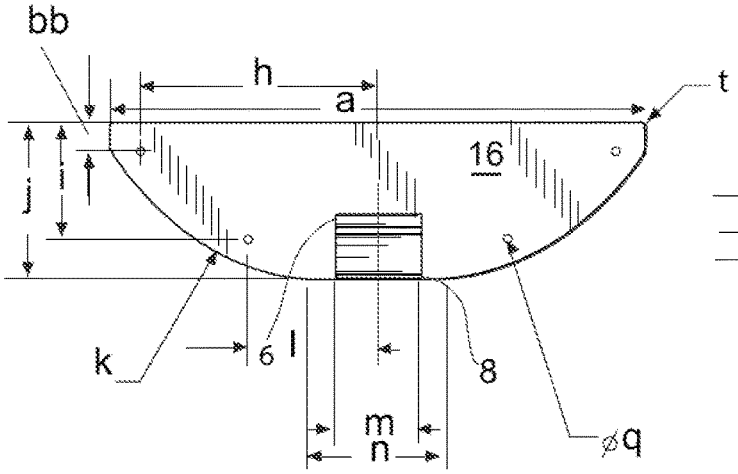
FIG. 4 is a rear view of the mount shown in FIG. 1.
Figure 5:
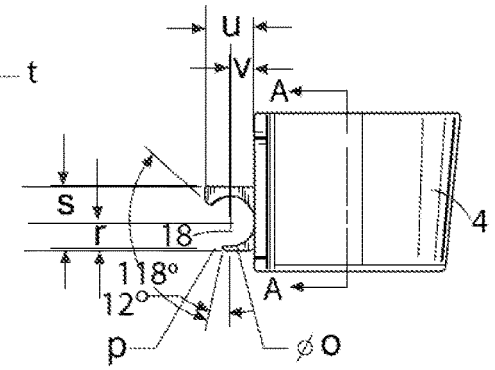
FIG. 5 is a left side view of the mount shown in FIG. 1, the right side being a minor image.
Figure 6:
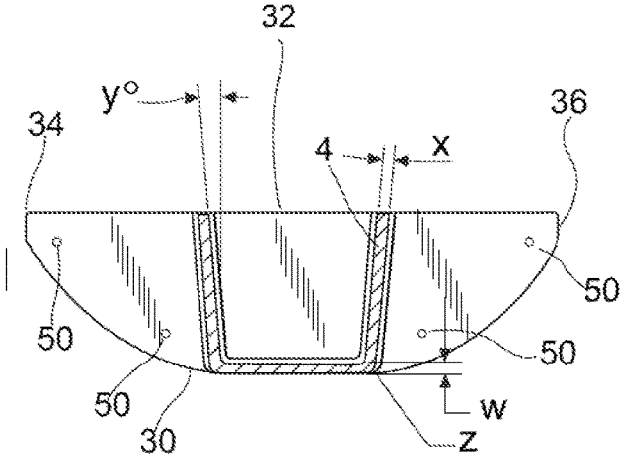
FIG. 6 is a cross-sectional view taken along line A-A in FIG. 5.

As shown in FIGS. 4 and 6, the planar member 2 may preferably be provided with a plurality of pilot holes for insertion of self-threading screws 52 to fasten the planar member 2 to a rail or rails of a folded chair.

Figure 8:
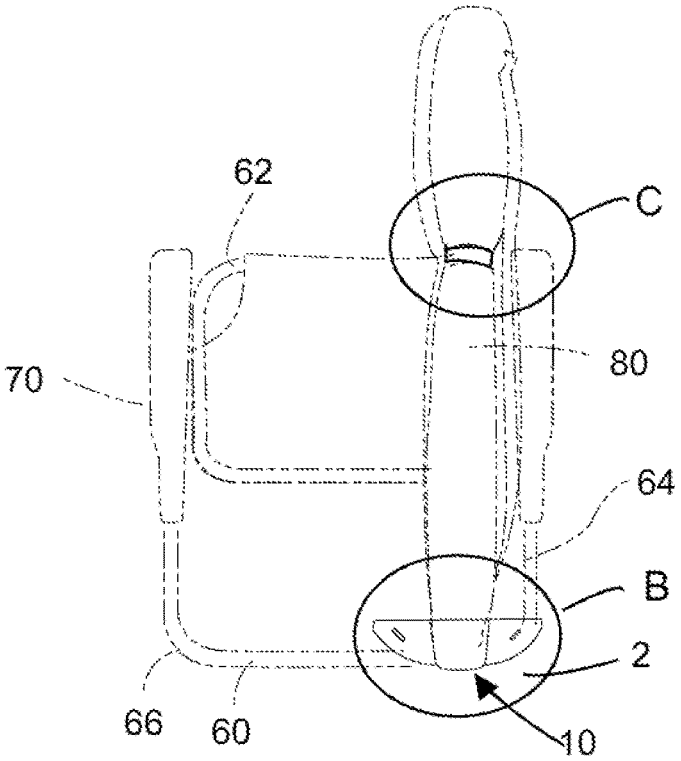
FIG. 8 is a plan view of an umbrella mounted to a folded beach chair with a mount and cinch strap of the kit of the invention.
Figure 9:
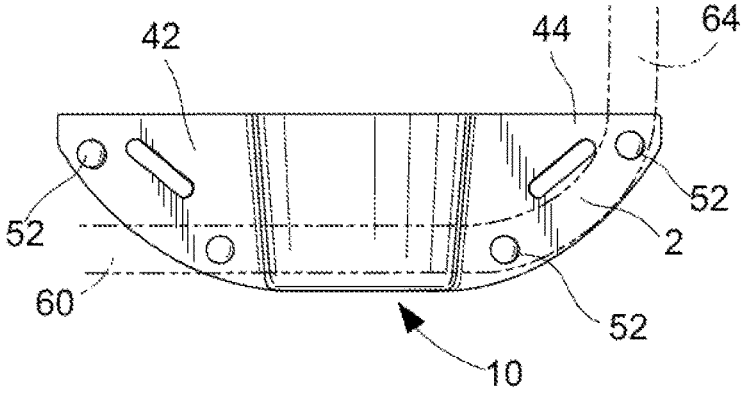
FIG. 9 is an enlarged view of area B encircled in FIG. 8.

As shown in FIGS. 8 and 9, the planar member 2 may be attached to the folded chair in an area where a first rail 60 intersects with a second rail 64 that is substantially perpendicular to the first rail 60. The mount 10 may be accurately positioned in the area by sliding, planar member 2 along rail 60 until respective of the plurality of holes 50 in flanges 42 and 44 align with both rail 60 and rail 64. In a preferred embodiment of the invention, the planar member 2 may then be fastened to the respective rails by, for example, screwing self-threading screws through holes 50 and into the rails 60 and 64. The screws can preferably be covered by screw caps to prevent the screws from rusting. In an alternative embodiment, the planar member 2 may be mounted on the rails with spring clamps or slide mounts, although these are less preferred embodiments insofar as the contours and dimensions of beach chairs may vary from one manufacturer to another. The use of self-threading screws provides for a universal fit for chairs of multiple manufacturers.

As would be appreciated by one of skill in the art, the semi-circular shape of the planar member and the disposition of the holes in the bottom portion of the flanges 42 and 44 enable fastening of the planar member 2 to the respective rails with the bottom of the planar member 2 aligned with, and not extending below, the bottom of rail 60. This is preferable insofar as, if the planar member 2 extends below the bottom of rail 60, bottom rail 60 night not lie flat on the ground with the chair 70 unfolded and in use as a seat. Although FIG. 9 shows mount 10 mounted on folded chair 70 in the area of intersection of rails 60 and 64, one of skill in the art would appreciate that the semicircular shape of planar member 2 and the symmetrical disposition of the members of the mount 10 would also enable a user to fasten the mount 10 on rails 60 and 66 in the area where these rails intersect on the opposite side of folded chair 70.

Figure 7:
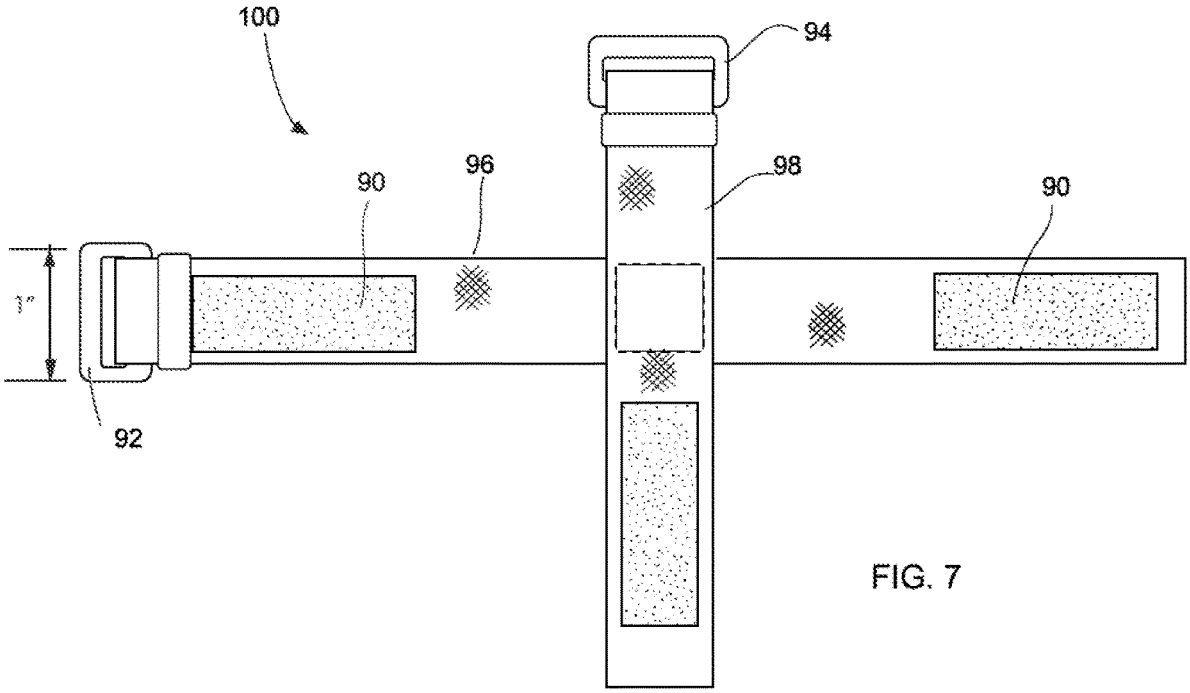
FIG. 7 is a plan view of a cinch strap for use in the kit of the invention in a preferred embodiment.
Figure 10:
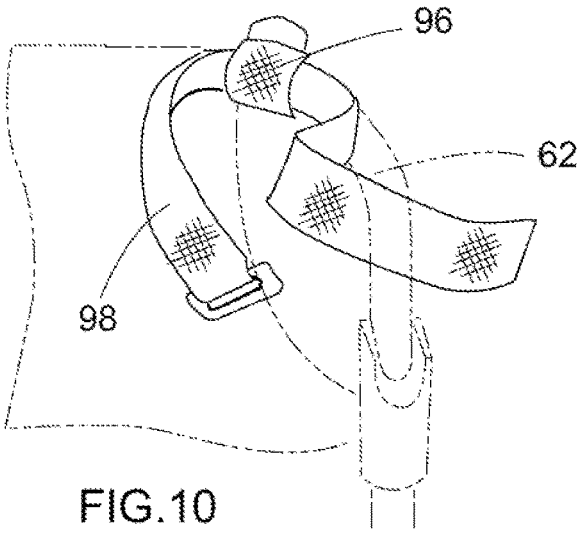
FIG. 10 is an enlarged view of the area C encircled in FIG. 8.

As shown in FIGS. 8 and 10, with the campy end of an umbrella resting in the mount 10, a shaft portion 80 of an umbrella or other elongate object may be detachably attached to a rail 62 of the folded chair 70 that is parallel to rail 60 at an opposite end of the folded chair with, by way of example, a strap or straps. A preferred attachment means comprises a cinch strap 100 as shown in FIG. 7 comprising strap portions 96 and 98 with the respective strap portions comprising buckles 92 and 94 and Velcro portions 90 which enable attachment to rail 62 and/or to a rail that is perpendicular thereto by wrapping one or both of the strap portions around the rail or rails and, if desired, threading the wrapped strap portions through one or both of the buckles 92 and 94 and securing the strap portions by pressing against one or more of the Velcro portions 90.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The embodiments were chosen and described in order to best explain the principles of the present disclosure and its practical application, to thereby enable others skilled in the art to best utilize the present disclosure and various embodiments with various modifications as are suited to the particular use contemplated. It is understood that various omission and substitutions of equivalents are contemplated as circumstance may suggest or render expedient, but such are intended to cover the application or implementation without departing from the spirit or scope of the following claims.

What is claimed is:

1. A kit for mounting an elongate object on a chair that is foldable from an unfolded configuration to a folded configuration, wherein the chair comprises a frame that, in the folded configuration, comprises (i) first and second tubular members disposed parallel to each other and (ii) third and fourth tubular members disposed parallel to each other and perpendicular to the first and second tubular members, the elongate object comprising opposed first and second ends and a shaft extending between the first and second ends of the elongate object, wherein the shaft has a length that is greater than a distance between the first and second tubular members of the chair, the kit comprising:

a mount comprising (a) a generally planar member having a front side, a back side, a top, a bottom and first and second opposed ends, the generally planar member having a length extending from the first end to the second end, (b) first means projecting from the front side of the generally planar member for receiving the first end of the elongate object with the chair in a folded configuration, (c) second means projecting from the back side of the generally planar member for mounting the mount on the first tubular member of the chair with the chair in the folded configuration, the first and second means being configured such that, with the chair in the folded configuration, with the first means receiving the first end of the elongate object and with the second means mounting the mount on the first tubular member, the shaft of the elongate object extends from the first means to and past the second tubular member of the chair; and third means for detachably attaching the shaft of the elongate object to the second tubular member of the chair with the shaft of the elongate object perpendicular to the second tubular member, with the first means receiving the first end of the elongate object and with the second means mounting the mount on the first tubular member of the chair;

wherein the first means comprises a U-shaped cup with legs of the U-shaped cup projecting from a central portion of the front side of the generally planar member, the U-shaped cup having a longitudinal axis that is perpendicular to the length of the generally planar member;

wherein the U-shaped cup comprises an open top and a closed or substantially closed bottom that prevents the first end of the elongate object from extending below the bottom of the generally planar member with the first end of the elongate object received in the U-shaped cup and the shaft of the elongate object attached to the second tubular member of the chair;

wherein the bottom of the U-shaped cup is aligned with the bottom of the generally planar member; and wherein the second means comprises first and second fins projecting from a central portion of the back side of the generally planar member, the first and second fins defining an opening for mounting the mount on the first tubular member, the opening being in a shape of a partial cyinder having a longitudinal axis that is parallel to the length of the generally planar member, the opening being dimensioned to allow the first and second fins to partially encircle the first tubular member and to slide the mount along the first tubular member with the mount mounted on the first tubular member.

2. The kit according to claim 1, wherein a bottom of the first fin is aligned with the bottom of the generally planar member and the second fin is disposed above the first fin on the back of the generally planar member.

3. The kit according to claim 2, wherein the generally planar member has first and second end portions on opposite sides of the central portion, the width of the planar member gradually narrowing from the central portion toward the respective first and second end portions.

4. The kit according to claim 3, wherein the generally planar member has a generally semi-circular shape.

5. The kit according to claim 1, wherein the mount is of unitary construction.

6. The kit according to claim 1, wherein the third means comprises a strap or plurality of straps.

7. The kit according to claim 1, wherein the third means comprises a cinch strap.

8. The kit according to claim 7, further comprising means for securing the generally planar member to the first, second, third or fourth tubular members or a combination thereof.

9. The kit according to claim 8, wherein the means for securing the generally planar member comprises a plurality of self-threading screws.

10. The kit according to claim 9, wherein the generally planar member comprises a plurality of holes disposed in the central portion, first end portion and/or second end portion of the planar member for facilitating use of the self-threading screws to secure the generally planar member to one or two of the first, second, third or fourth tubular members.

11. A mount for an elongate object comprising (a) a generally planar member having a front side, a back side, a top, a bottom and first and second opposed ends, the generally planar member having a length extending between the first and second ends;

(b) first means projecting from the front side of the generally planar member for receiving the first end of the elongate object, wherein the first means comprises a U-shaped cup with legs of the U-shaped cup projecting from a central portion of the front side of the generally planar member, the U-shaped cup having a longitudinal axis that is perpendicular to the length of the generally planar member, wherein the U-shaped cup comprises an open top and a closed or substantially closed bottom that prevents the first end of the elongate object from extending below the bottom of the generally planar member with the first end of the elongate object received in the U-shaped cup, and wherein the bottom of the U-shaped cup is aligned with the bottom of the generally planar member;

(c) second means projecting from the back side of the generally planar member for mounting the article on a tubular member of a foldable chair with the foldable chair in a folded configuration, wherein the second means comprises first and second fins projecting from a central portion of the back side of the generally planar member, the first and second fins defining an opening for mounting the mount on the first tubular member of the foldable chair, the opening being in the shape of a partial cylinder having a longitudinal axis that is parallel to the length of the generally planar member, the opening being dimensioned to allow the first and second fins to partially encircle the tubular member and enable the mount to slide along the first tubular member with the mount mounted on the first tubular member, wherein a bottom of the first fin is aligned with the bottom of the generally planar member and the second fin is disposed above the first fin on the back of the generally planar member.

12. The mount according to claim 11, wherein the generally planar member has first and second flanges on opposite sides of the central portion that extend beyond the cup and the fins in the central portion of the generally planar member, and wherein the width of the generally planar member gradually narrows from the central portion toward the respective first and second ends of the generally planar member.

13. The mount according to claim 12, wherein the generally planar member has a generally semi-circular shape.

14. The mount according to claim 13, wherein the mount is of unitary construction.

15. A method for transporting an elongate object together with a folded chair comprising the steps of:

(i) providing a kit for mounting an elongate object on the folded chair, wherein the folded chair comprises a frame that comprises (i) first and second tubular members disposed parallel to each other and (ii) third and fourth tubular members disposed parallel to each other and perpendicular to the first and second tubular members, the elongate object comprising opposed first and second ends and a shaft extending between the first and second ends of the elongate object, wherein the shaft has a length that is greater than a distance between the first and second tubular members of the folded chair, the kit comprising a mount comprising (a) a generally planar member having a front side, a back side, a top, a bottom and first and second opposed ends, the generally planar member having a length extending from the first end to the second end, (b) first means projecting from the front side of the generally planar member for receiving the first end of the elongate object, (c) second means projecting from the back side of the generally planar member for mounting the mount on the first tubular member of the folded chair, the first and second means being configured such that, with the first means receiving the first end of the elongate object and with the second means mounting the mount on the first tubular member of the folded chair, the shaft of the elongate object extends from the first means to and past the second tubular member of the folded chair; and third means for detachably attaching the shaft of the elongate object to the second tubular member of the folded chair with the shaft of the elongate object perpendicular to the second tubular member, with the first means receiving the first end of the elongate object and with the second means mounting the mount on the first tubular member of the folded chair;

(ii) mounting the mount of the kit onto the first tubular member of the folded chair at one end of the folded chair;

(iii) inserting one end of the elongate object into the mount;

(iv) attaching a shaft of the elongate object to an opposite end of the folded chair with the third means; and (v) transporting the elongate object and the folded chair as a single assembly.

16. The method according to claim 15, wherein the folded chair is a beach chair and the elongate object is an umbrella.

17. The method according to claim 15, wherein the second means comprises first and second fins projecting from a central portion of the back side of the generally planar member, the first and second fins defining an opening for mounting the mount on the first tubular member, the opening being in a shape of a partial cylinder having a longitudinal axis that is parallel to the length of the generally planar member, the opening being dimensioned to allow the first and second fins to partially encircle the first tubular member and to slide the mount along the first tubular member with the mount mounted on the first tubular member, and wherein the mounting step (ii) comprises disposing the generally planar member with the first and second fins partially encircling the first tubular member of the folded chair.

18. The method according to claim 17, wherein the first means comprises a U-shaped cup with legs of the U-shaped cup projecting from a central portion of the front side of the generally planar member, the U-shaped cup having a longitudinal axis that is perpendicular to the length of the generally planar member.

19. The method according to claim 18, wherein the U-shaped cup comprises an open top and a closed or substantially closed bottom that prevents the first end of the elongate object from extending below the bottom of the generally planar member with the first end of the elongate object received in the U-shaped cup and the shaft of the elongate object attached to the second tubular member of the chair.

20. The method according to claim 19, wherein the bottom of the U-shaped cup is aligned with the bottom of the generally planar member.

* * * * *